US005314349A

United States Patent [19]

Czeschka et al.

[11] Patent Number: 5,314,349

[45] Date of Patent: May 24, 1994

[54] CONNECTOR FOR COAXIAL CABLE

[75] Inventors: Franz Czeschka, Rechberghausen; Roland Mödinger, Weinstadt, both of Fed. Rep. of Germany

[73] Assignee: ERNI Elektroapparate GmbH, Adelberg, Fed. Rep. of Germany

[21] Appl. No.: 44,125

[22] Filed: Apr. 8, 1993

[30] Foreign Application Priority Data

Apr. 16, 1992 [DE] Fed. Rep. of Germany ..... 4212710

[51] Int. Cl.[5] ..... H01R 4/24

[52] U.S. Cl. ..... 439/394; 439/63; 439/581

[58] Field of Search ..... 439/578-585, 439/389, 394, 63, 675

[56] References Cited

U.S. PATENT DOCUMENTS

| | | | |
|---|---|---|---|
| 4,626,058 | 12/1986 | Prince et al. | 439/394 |
| 4,691,976 | 9/1987 | Cowen | 439/582 |
| 4,746,307 | 5/1988 | Joly et al. | 439/582 |
| 5,011,428 | 4/1991 | Heng et al. | 439/394 |
| 5,062,804 | 11/1991 | Janset et al. | 439/394 |
| 5,167,525 | 12/1992 | Wang | 439/394 |

*Primary Examiner*—David L. Pirlot

*Attorney, Agent, or Firm*—Anderson Kill Olick & Oshinsky

[57] ABSTRACT

A coaxial cable connector includes electrically conductive base and cover securable to each other and defining together a cavity, in which an insulation stripping contact is located, and a cable feed which opens into the cavity. The connector further includes an insulation member, which separates the insulation stripping contact from shielded conductor elements, and a thrust member cooperating with the insulation stripping contact for connecting a received cable portion thereto.

17 Claims, 3 Drawing Sheets

Fig.1
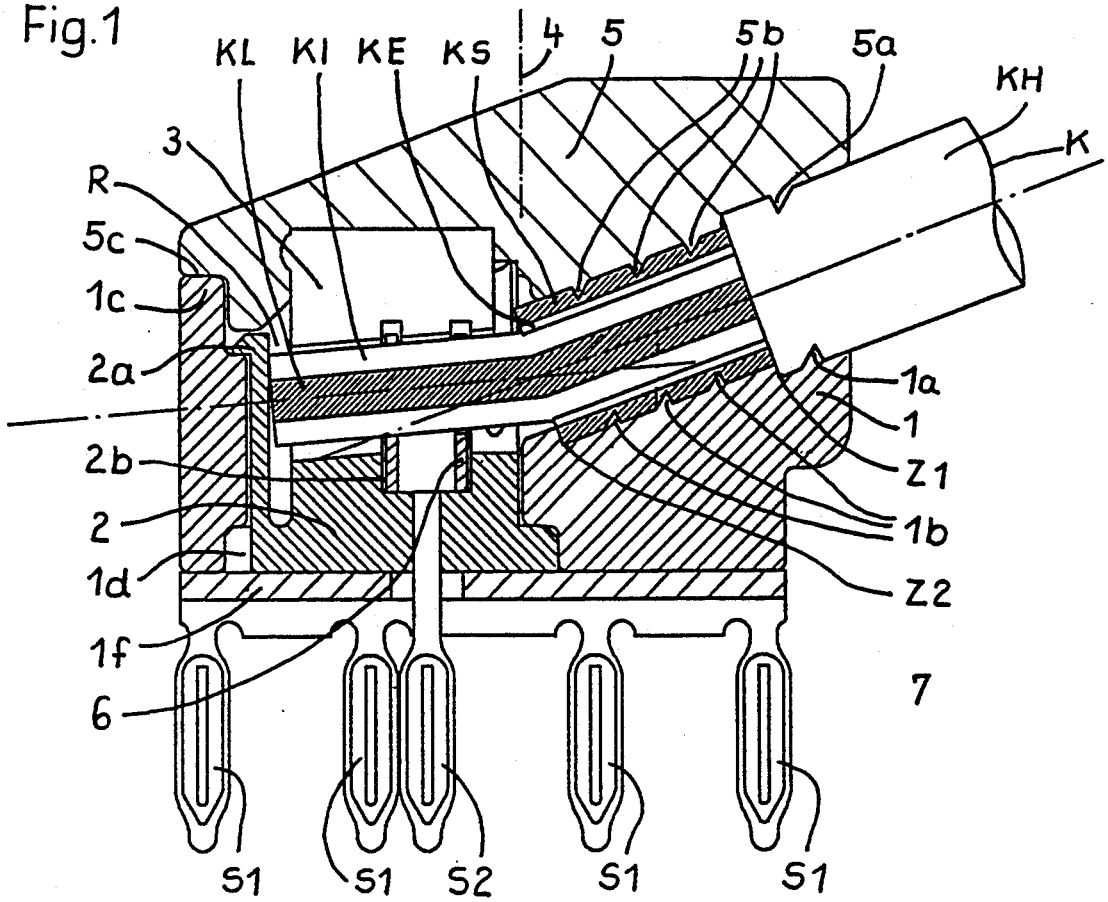
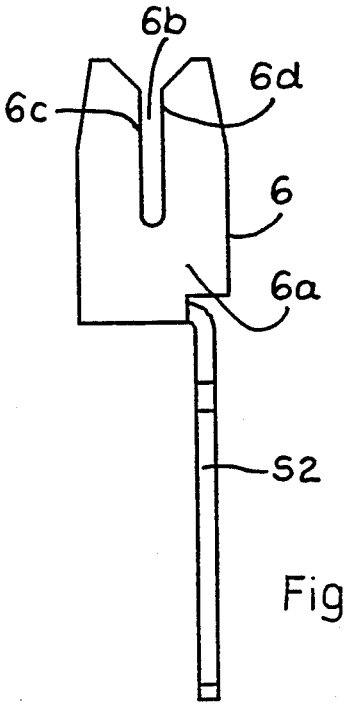
Fig. 1b
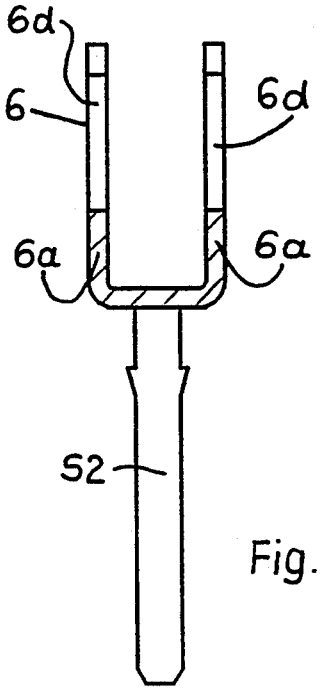
Fig. 1a

CONNECTOR FOR COAXIAL CABLE

BACKGROUND OF THE INVENTION

The invention relates to a coaxial cable connector having a plurality of elements for abuttingly connecting the connector to a printed circuit plate.

In power transmission, special coaxial cables are used which have a hollow cylindrical outer conductor part and a concentric therewith inner conductor part, which is inserted in the outer conductor part and is surrounded with insulation, wherein the outer part simultaneously serves as a protective shield.

The coaxial cable conventionally is solded to a printed circuit plate.

DE-GM 80 27 565 discloses use of an angle piece secured to a carrier plate (printed circuit plate) and having a portion defining a coaxial connector. In this case, an end of a coaxial cable should be provided with a corresponding counterpart of the coaxial connector element for effecting a connection. The so-called cold soldering joint is another drawback. In addition, a plurality of separate parts increase the costs of assembly. These assembly costs are especially high when the assembly is effected not in place of use, and especially when a defective cable should be replaced.

Accordingly, the main object of the invention is a connector for connecting at least one coaxial cable with a printed circuit board or plate and which has a small number of separate parts, permits to reduce assembly costs, and insures a good electrical contact and appropriate shielding.

SUMMARY OF THE INVENTION

This and other objects of the invention are achieved by providing a connector that includes electrically conductive base and cover securable to each other and defining together a cavity, in which at least one insulation stripping contact is located, and a cable feed for receiving an inner conductor part of a coaxial cable. This connector further includes a thrust member which is, preferably, secured to the cover and cooperates with the insulation stripping contact for connecting the coaxial cable thereto. The connector also includes an insulation member which insulates the insulation stripping contact from the shielded conductor parts.

BRIEF DESCRIPTION OF THE DRAWINGS

FIG. 1 shows a longitudinal cross-sectional view of a coaxial cable connector with a connected coaxial cable;

FIG. 1*a* shows a cross-sectional view of an insulation stripping contact;

FIG. 1*b* shows a side view of an insulation stripping contact;

DETAILED DESCRIPTION OF THE PREFERRED EMBODIMENTS

Figure 2:
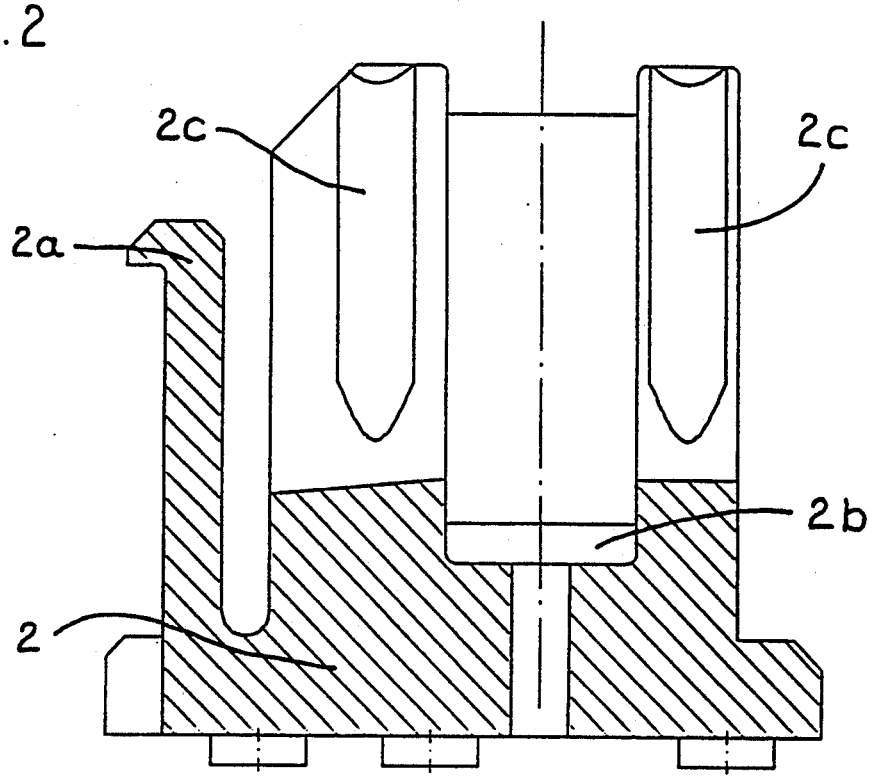
FIG. 2 shows a cross-sectional view of an insulation member.
Figure 3:
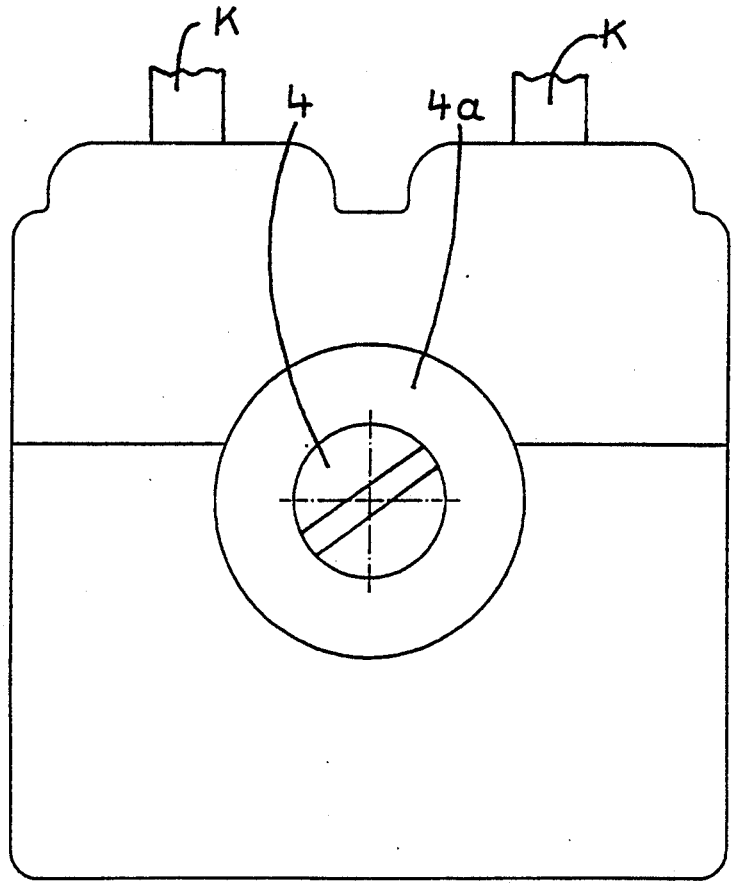
FIG. 3 shows a plan view of a coaxial cable connector according to the present invention, which is adapted to connect at least two coaxial cables.

A coaxial cable connector, which is shown in FIG. 1, consists essentially of two parts, a base 1 and a cover 5. The electrically conductive cover 5 form together a cavity R. An insulation stripping contact 6, which is connected with a connection element S2, and an electrically insulated thrust member 3, which is operatively connected with the insulation stripping contact 6 and is arranged opposite thereof, are located in cavity R. The insulation stripping contact 6 is insulated by an insulation member 2 from a shielded conductor line. The base 1 and the cover 5 define at least one cable clamping and bonding feed Z1–Z2 which opens into the cavity R. The base 1 and the cover 2 are connected with preferably separable force-transmitting elements 4, advantageously screw connecting elements which includes a spring washer 4*a*. The base 1 and cover 5 are so formed in the region of the cable feed that the cable feed comprises a cylindrical recess Z1, which is preferably provided with barbs 1*a*, 5*a* and a cylindrical recess Z2, which is provided with annular sharp projections 1*b* and 5*b*.

The insulation stripping contact 6 is shown in detail in FIGS. 1*a* and 1*b*. It has preferably two arms 6*a*. The side of the insulation stripping contact 6, which is adjacent to the thrust member, is provided with a slot 6*b* and two opposite knives 6*c* and 6*d*. A connection element S2 is preferably fixedly secured to the bottom side of the insulation stripping contact 6.

The insulation stripping contact 6 is located in a recess 2*b* of the insulation member 2, which is retained in an opening 1*d* of the base 1 by a snap hook 2*a*. The insulation member 2 insulates the insulation contact 6 from the electrically conductive base 1.

Connection of a coaxial cable is effected, according to the invention, in the following manner. A bared cable portion is placed in corresponding elements Z1, Z2 R and 6 in the base 1 and is pressed against the base 1 by the cover 5 under action of screw means 4. At that, a thrust member 3 supported on the cover 5, acts on an inner cable conducting portion KL, which is still insulated with insulation K1, and presses the inner conducting portion KL into the insulation stripping contact 6. The knives 6*c* and 6*d* cut off the insulation K1 and penetrate into the portion KL. In this way, the inner conducting portion KL is force- and formlockingly connected with the insulation stripping contact 6. Simultaneously, the sheath braiding KS of the cable is clamped in the recess Z2 by the sharp projections 1*b* and 5*b*. In the region of the cylindrical recess Z1, the sleeve KM is relieved of tensile stresses by barbs 1*a* and 5*a*.

With a circular projection 5*c* of the cover 5 engaging a land 1*c* of the base 1, the inner space of the coaxial cable connector is sealed from all sides.

Before or after the cable connection, the bottom surface of base 5 is connected with a printed circuit plate 7. Preferably, the connecting elements S1 and S2 have a form of an insert peg. Advantageously, the connecting elements S1 are formed integrally, as one piece, with a bottom part, 1*f*, which is preferably replaceably secured to the base 1. This part permits a very quick and simple connection of the connector and, thus, the cable to a printed circuit plate or a structural element supported on this plate. Thereby, a fixed connection of the coaxial cable is provided which connection, however, if needed, can be simply released. Such a connection also provides for use of a small number of separate parts.

Figure 4:
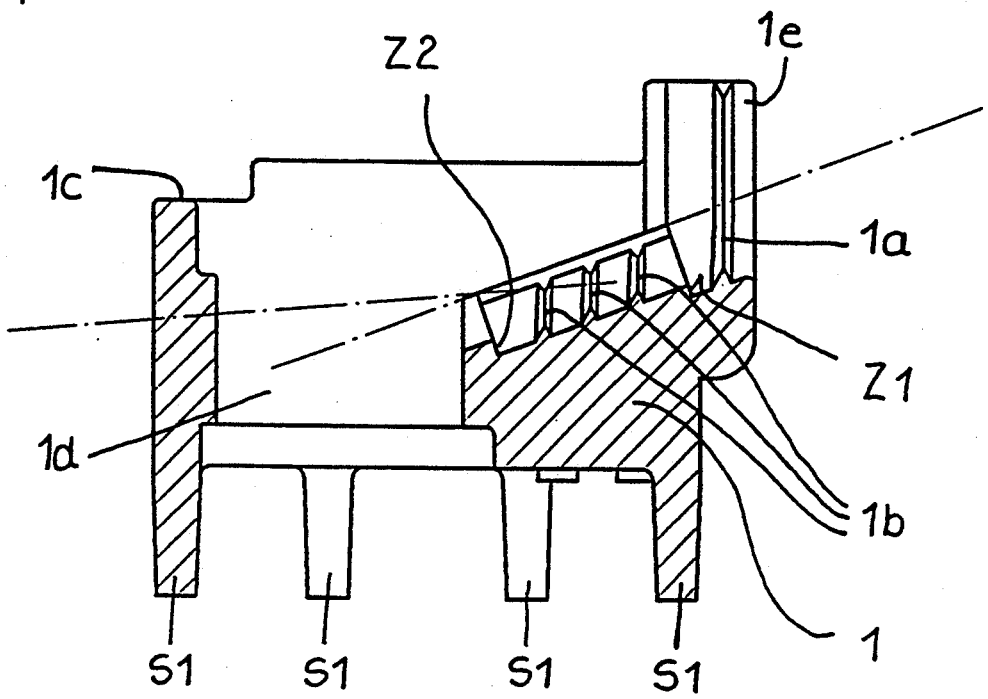
FIG. 4 shows a longitudinal cross-sectional view of the base of coaxial cable connector according to the present invention.
Figure 4A:
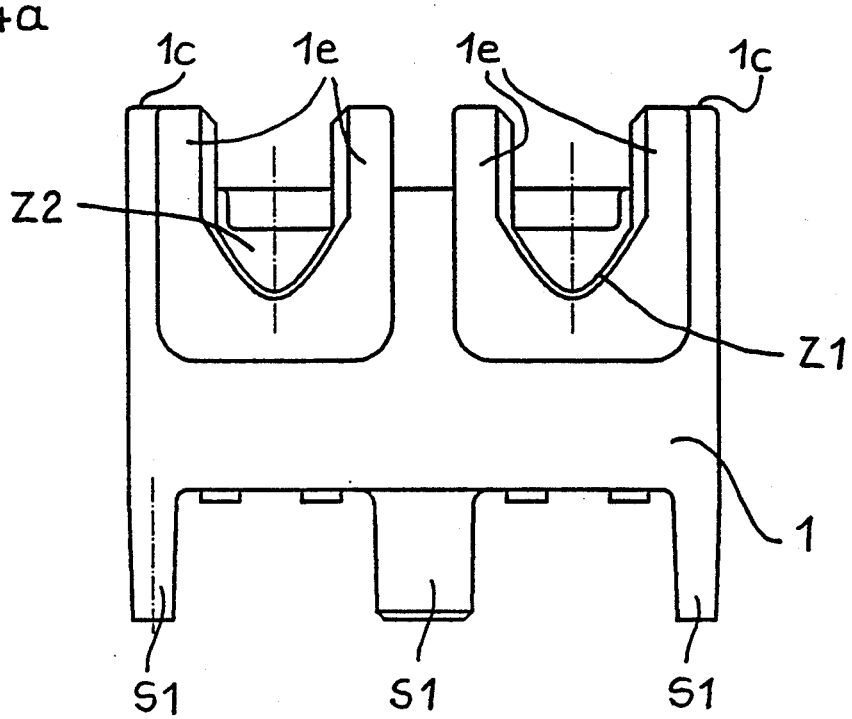
FIG. 4*a* shows a view of the base of a coaxial cable connector according to the present invention, which is taken from the cable entry side thereof.

Even a larger advantageous effect is obtained with an embodiment of a coaxial cable connector which permits connection of several cables. This embodiment is characterized in that for securing the cable K to the base 1 in the region of the recess Z1, a fixing land 1*e* is provided on both sides of the barb 1*a* and over the upper edge of the base 1, FIGS. 4 and 4*a*. In this embodiment, the insulation member 2 has, in the vicinity of knives 6*c* and 6*d* of the insulation stripping contact 6, at least two opposite fixing projections 2*c*. Further, the barbs 1*a* in the base 1 have a form of an annular cutter element and at least partially project into at least one fixing land 1*e*.

Advantageously, the insulation member 2 is formed as one piece and preferably a thrust member 3 is associated with each insulation stripping contact. Also the cable feed Z1, Z2 preferably does not extend parallel to the bottom surface of the base 1. Finally, a space-saving feed for the cable K is brought about.

If the connecting elements S1 are formed as peg- or strip like soldered filaments, it is advantageous to form them integrally with the base 1. A thermally stable sleeve KE is placed in a known manner between the sheath braiding KS and the insulation K1.

While the present invention has been shown and described with reference to the preferred embodiments, various modification thereof will be apparent to those skilled in the art, and therefore, it is not intended that the invention be limited to the preferred embodiments or the details thereof, and departures can be made therefrom within the spirit and scope of the invention as defined in the appended claims.

What is claimed is:

1. A connector for a coaxial cable, comprising:

an electrically conductive base;

an electrically conductive cover securable to said base and defining therewith a cavity and at least one cable clamping and contacting feed which opens into said cavity;

at least one insulation stripping contact located in said base and having a connection element;

an electrically insulated thrust member arranged opposite said insulation stripping contact and cooperating therewith;

an insulation member for insulating said insulating stripping contact from shielded conductor means;

force-transmitting means for connecting said base and said cover together; and a plurality of connecting elements for abuttingly connecting said connector to a printed circuit plate.

2. A connector according to claim 1, wherein said insulation stripping contact has at least one arm which is provided, at a side thereof facing said thrust member with a recess and two oppositely arranged knives.

3. A connector according to claim 1, wherein said base has an annular land, and said cover has a projection abutting said annular land whereby said base and said cover are separated by said feed.

4. A connector according to claim 1, wherein said feed extends at an angle to a bottom surface of said base.

5. A connector according to claim 1, further comprising a plurality of insulation stripping contacts, and a respective plurality of thrust members so that a thrust member corresponds to each insulation stripping contact.

6. A connector according to claim 1, further compromising a bottom part which is attached to a bottom surface of said base and carries said connecting elements.

7. A connector according to claim 1, wherein said feed comprises a first cylindrical recess provided with barb means, and a second cylindrical recess provided with annular sharp projections.

8. A connector according to claim 7, wherein said barb means is formed as a circular cutter.

9. A connector according to claim 7, wherein said base has, in a region of said first recess in an area of said barb means a fixing land located on both sides of said barb means, and projecting over an upper edge of said base.

10. A connector according to claim 9, wherein said barb means at least partially extends into said fixing land.

11. A connector according to claim 1, wherein said insulation member is located in an opening formed in said base and has a snap hook for being retained therein, said insulation member having a recess for receiving said insulation stripping contact.

12. A connector according to claim 11, wherein said insulation member has, in vicinity of said knives of said insulation stripping contact, opposite fixing projections.

13. A connector according to claim 1, wherein it is adapted to receive a plurality of cables.

14. A connector according to claim 13, wherein said insulation member is formed as a one-piece part.

15. A connector according to claim 1, wherein said base and said connecting elements are formed as a one-piece part.

16. A connector according to claim 15, wherein said connecting elements have a form of an insert peg.

17. A connector according to claim 15, wherein said connecting elements have a form of one of a solded filament peg and a solded filament strip.

* * * * *